US006002333A

United States Patent [19]

Hickey

[11] Patent Number: 6,002,333

[45] Date of Patent: Dec. 14, 1999

[54] ALARM SYSTEM TO ASSIST IN GAUGING THE SIZE OF A DOOR OPENING

[76] Inventor: Mark J. Hickey, 2645 Hickory Lawn, Rochester Hills, Mich. 48307

[21] Appl. No.: 08/610,500

[22] Filed: Mar. 6, 1996

[51] Int. Cl.[6] ..... G08B 13/00

[52] U.S. Cl. ..... 340/550; 340/566; 340/691.5; 340/693.11

[58] Field of Search ..... 340/550, 545.1, 340/546, 566, 665, 436, 437, 932.2, 541, 686.6, 691.5, 693.1, 693.5, 693.11; 200/61.41, 61.45 R, 61.45 M, 61.47–61.51

[56] References Cited

U.S. PATENT DOCUMENTS

| | | | |
|---|---|---|---|
| 3,180,950 | 4/1965 | Jacobsen | 340/932.2 X |
| 3,478,311 | 11/1969 | Czingula | 340/932.2 |
| 3,612,460 | 10/1971 | Smith | 40/607 |
| 3,797,005 | 3/1974 | Schwarz | 340/545 X |
| 4,193,067 | 3/1980 | Hawkins | 340/546 |
| 4,205,874 | 6/1980 | Martin | 296/102 |
| 4,346,666 | 8/1982 | Iso | 116/63 R |
| 4,490,917 | 1/1985 | Pilling | 33/264 |
| 4,812,824 | 3/1989 | Holt | 340/566 |
| 4,888,578 | 12/1989 | Conemac | 340/546 |
| 4,896,139 | 1/1990 | Eldridge | 340/546 |
| 5,089,806 | 2/1992 | Willis et al. | 340/541 |
| 5,170,996 | 12/1992 | Venegas, Jr. et al. | 256/69 |
| 5,230,296 | 7/1993 | Giltz et al. | 116/28 R |
| 5,261,647 | 11/1993 | Venegas, Jr. et al. | 256/13.1 |
| 5,474,016 | 12/1995 | Haney | 116/28 R |

FOREIGN PATENT DOCUMENTS

| | | | |
|---|---|---|---|
| 2421428 | 11/1979 | France | 340/545 |
| 3419526 | 11/1985 | Germany | 340/545 |

*Primary Examiner*—Thomas Mullen
*Attorney, Agent, or Firm*—Harness, Dickey & Pierce, P.L.C.

[57] ABSTRACT

A barrier alarm for positioning adjacent a door opening includes an elongated tubular body having a vibration-sensing relay fitted thereto. The relay is able to distinguish between a smooth, continuous movement such as associated with the swinging arc motion effected by a breeze and the instantaneous vibration effected by being impacted by a rigid object. The power source may be integrated with the body or may be remote. The power source may be a direct current source or may be an alternating current source. The alarm may be audible or visible or both. The alarm may be integrated with the body or may be remotely positioned. The barrier alarm may be provided in an array that is horizontally-positioned with respect to the top portion of the door jamb or may be vertically positioned with respect to the door. A combination of this arrangement may be used.

18 Claims, 4 Drawing Sheets

ALARM SYSTEM TO ASSIST IN GAUGING THE SIZE OF A DOOR OPENING

BACKGROUND OF THE INVENTION

I. Field of the Invention

The present invention relates to alarm systems. More particularly, the present invention relates to an alarm system having sensors positionable along the top or sides of a door opening so as to announce when an article strikes one or more of the sensors, thus alerting a vehicle operator that the size of the article is too great to pass through the door.

II. Background of the Invention

The movement of wheeled vehicles around, between and through structures often creates considerable risk of damage. For example, because of the narrowness of throughways and the restricted height of parking structures or parking decks, automobiles navigating such structures frequently risk impacting pillars, walls, or ceilings. Similarly, automobiles driving around and through drive-up windows at fast-food restaurants or in banks suffer the same potential hazards. Articles of manufacture are frequently moved within the manufacturing facility, a warehouse, or a retail store before finding their way to the end user. Frequently these objects are moved through doors or other passageways formed in or adjacent to the building. Frequently these articles are moved by hand, but even more frequently such articles are moved by motorized vehicles such as high-lows.

The construction of a typical high-low is such that the operator is positioned in such a place so as to have an unobstructed view of his environment at such time as there is no load on the vehicle. However, when the vehicle is loaded with one or more boxes, crates, or uncrated but bulky goods, the operator's view is often obstructed, particularly when the grids are elevated to enable the vehicle to move about. In such circumstances, the first point of view to be compromised is the view directly in front of the operator.

The result of this obstructed view is too frequently damaged goods and a damaged header above the door frame. Not only is the damage to the header costly, frequently ranging in the thousands of dollars, this damage also compromised the structural integrity of the door as a whole, even when correctly repaired. This presents a safety problem. A similar situation arises when a load is overly wide for a door opening. When the operator attempts to pass through the doorway with such a load, again the goods are damaged as well as the sides of the door frame.

Little, if anything, has been done to alleviate this problem. A variety of alarm systems are known of both the mechanical and electronic type. These include, for example, U.S. Pat. No. 3,612,460, issued Oct. 12, 1971, to Smith, U.S. Pat. No. 5,089,806, issued Feb. 18, 1992, to Willis et al., U.S. Pat. No. 5,230,296, issued Jul. 27, 1993, to Giltz et al., and U.S. Pat. No. 5,474,016, issued Dec. 12, 1995, to Haney. However, these alarm systems, without more, fail to effectively or efficiently address the problems associated with the movement of goods and boxes within the shop, warehouse, or place of manufacture. Accordingly, there remains wanting a system which will protect the door frame of a door during movement of articles therethrough.

BRIEF DESCRIPTION OF THE PRESENT INVENTION

It is accordingly an object of the present invention to provide an alarm system that announces to movers that the load being conveyed is too large given the door opening.

Another object of the present invention is to provide such a system that includes one or more sensors that may be attached to one or both sides of a door frame.

A further object of the present invention is to provide such an alarm system which incorporates a vibration-sensitive switch which is sensitive to the instantaneous movement of a sudden impact but which is not responsive to more gradual movement caused by wind.

Still a further object of the present invention is to provide such an alarm system which comprises one or more elongated tubes to function as the sensors.

Yet an additional object of the present invention is to provide such an alarm system which incorporates a vibration sensor in or on the sensor tube.

A further object of the present invention is to provide such an alarm system which incorporates a visual alarm indicator.

Still a further object of the present invention is to provide such an alarm system which incorporates one or more lights into the sensor tube to provide the visual alarm.

Yet another object of the present invention is to provide such an alarm system which incorporates an audio alarm.

Still a further object of the present invention is to provide an audio alarm which is incorporated into the sensor tube.

The alarm system of the present invention achieves these and other objects by comprising one or more elongated sensors that are positionable around the opening of a door defined by the door jamb. The sensors may be fitted on one or both sides of the door and may be positioned adjacent to the door header or the two upright portions of the jamb or in all of these places.

The alarm sensor comprises an elongated, substantially hollow tube. In or on the tube are fitted one or more vibration-sensitive switches, such as a mercury switch. In its integral form, the sensor tubes may also be fitted with a storage battery, an alarm, and the circuitry necessary to connect the switch, the battery, and the alarm. Alternatively, either or both the storage battery and the alarm may be remotely positioned from the sensor tube. The tube itself may be composed of a rigid, impact-resistant plastic.

The form of the alarm may be either or both audio or visual. If visual, two alarms may be fitted to the open ends of the sensing tube. The audio form of the alarm may be one or more bells, sirens, horns, or buzzers.

The sensor tube may be mounted adjacent the door jamb through any of a variety of means, including brackets, chains, or cable to preferably provide free swinging movement. The form of mounting is not as important as is the need for the mounting scheme to allow for relatively free movement of the tube with respect to the adjacent door jamb.

By providing sensors above or to the side of the door opening, the alarm system prevents the inadvertent impact of a box, crate, or uncrated article against the door.

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views and in which.

DETAILED DESCRIPTION OF THE PREFERRED EMBODIMENTS OF THE PRESENT INVENTION

The drawings disclose the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Figure 1:
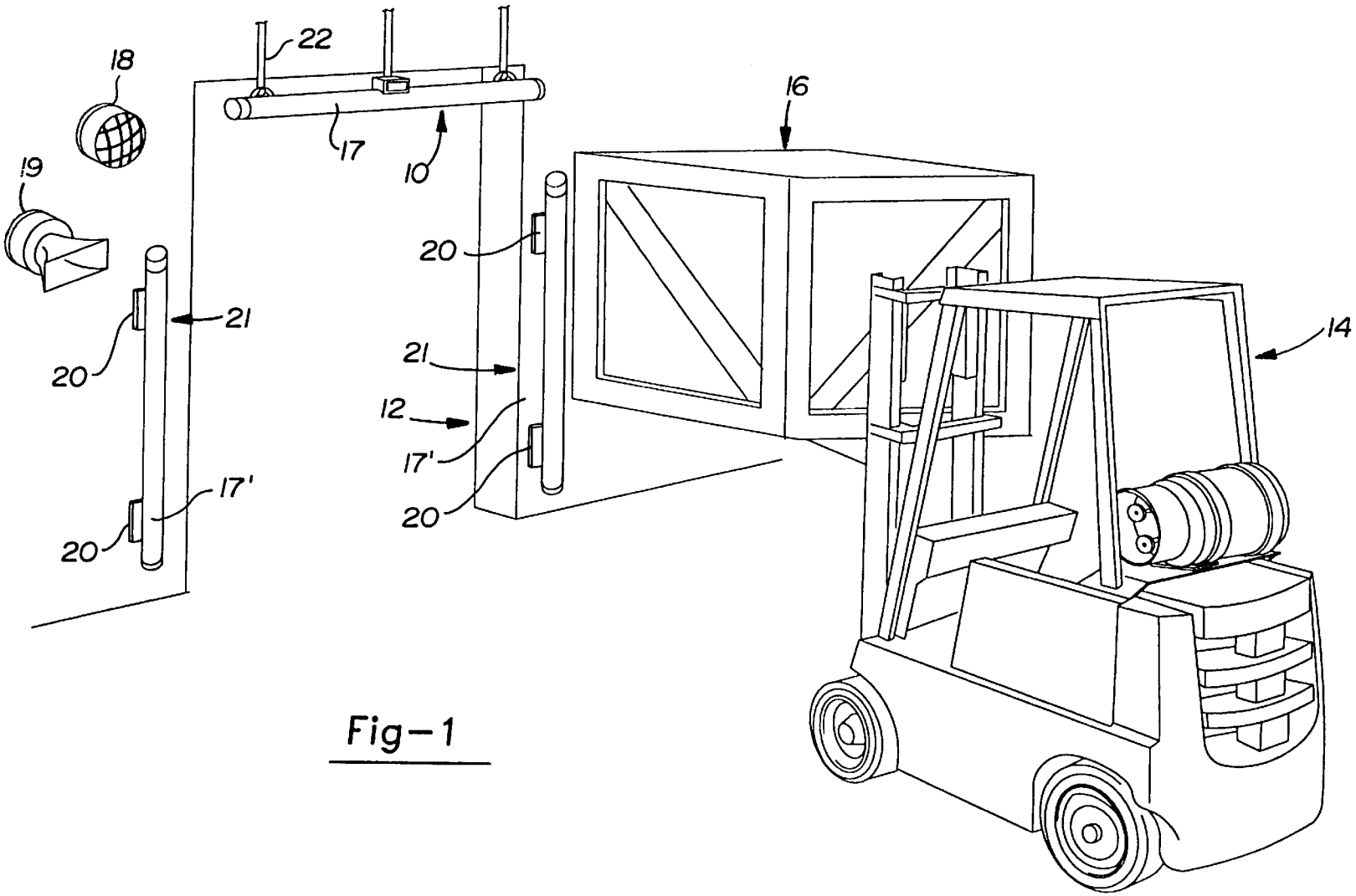
FIG. 1 is an environmental view of both horizontal and vertical barrier alarms of the present invention positioned adjacent a door opening and a crated article being supported by a high-low.

Referring to FIG. 1, a barrier alarm, generally illustrated as 10, is shown adjacent a door opening, generally illustrated as 12. A high-low 14 is shown moving a crated article 16. In the event that the upper end of the article 16 is too tall for the door opening, the high-low operator (not shown) would be instantaneously apprised of this fact as he attempts to transport the article 16 through the opening 12 by first making contact with the barrier alarm 10. The alarm 10 includes a sensor body 17. The alarm 10 may indicate warning by engaging a flashing light 18 or a siren 19. Other methods of alarm will be discussed below with respect to FIGS. 2, 3, and 4.

It is to be noted that while the door opening 12 is shown as being of the type frequently seen in storerooms and warehouses, it is to be understood that the barrier alarm 10 of the present invention may find application adjacent other doors and openings, such as those provided in parking structures or associated with drive-in services such as for restaurants and banks. The barrier alarm 10 may also be used adjacent garage doors (both in home and commercial applications) and so-called "speed doors". Accordingly, the barrier alarm 10 may find use in virtually any environment in which doors are used and there exists the simultaneous risk that goods being moved through the door could inadvertently make contact with the door jamb or the adjacent walls.

As shown in FIG. 1, the barrier alarm 10 is suspended from the ceiling of the room by a series of supports 22. The supports 22 may be straps, chains, or cables. Other methods of attachment are possible. The only requirement of the method of attachment is that it be allowed to give somewhat such that its perpendicular position with respect to the ceiling may be altered without damaging the method of connection, the alarm 10, or the ceiling. The barrier alarm 10 of the present invention is designed such that slight swaying of the alarm 10 by, for example, a breeze would not engage the alarm. Accordingly, the method of support may well be flexible.

In some circumstances wide articles, such as sofas, lumber or piping, may be moved from one place to another within the storeroom or warehouse. In that event, it may be desirable to fit the alarms of the present invention in a substantially vertical position adjacent the upright walls of the door opening. FIG. 1 illustrates such an arrangement. A pair of spaced apart barrier alarms 21 are fitted adjacent the vertical portions of the door jamb of the opening 12. As with the alarm 10 discussed above, the alarms 21 respond to instantaneous vibrations caused by being impacted by a rigid object. The barrier alarms 21 are mounted to the upright walls adjacent the opening 12 by a series of semi-flexible brackets or springs 20 which allow sensor bodies 17' of the alarms 21 to vibrate in response to being struck by an overly-wide object (not shown). The barrier alarms 21 may be mounted to the floor by a semi-flexible member such as a spring (not shown). Alternatively, the alarms may be mounted such that they may be broken away from the floor if struck by a moving object. While this would lead to damage to the alarm 21, the door opening 12 would be saved from injury. This is a far less costly outcome than the opening 12 suffering injury.

Figure 2:
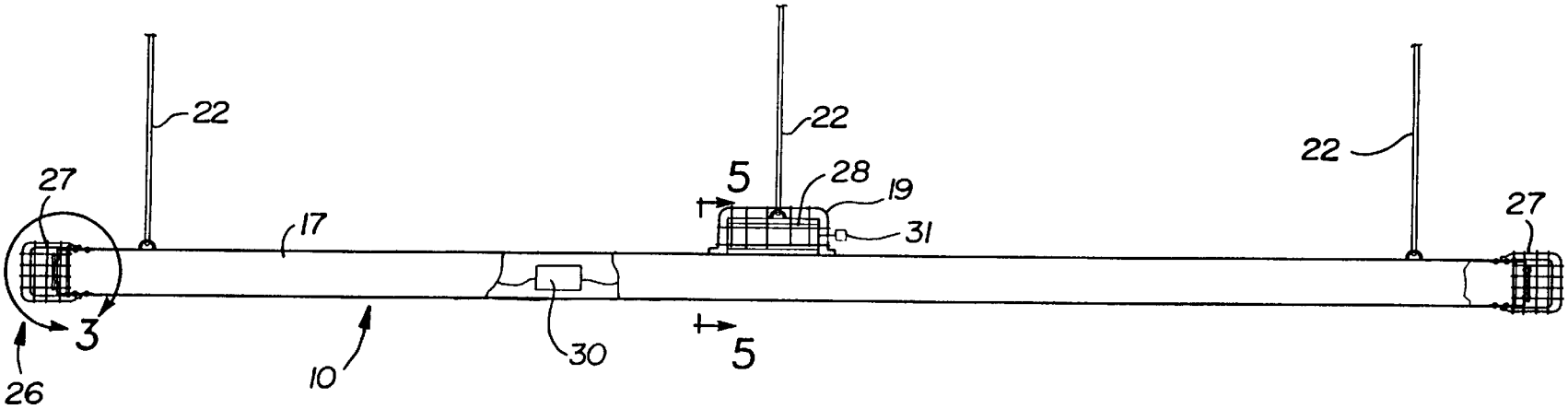
FIG. 2 is a front view of the barrier alarm of FIG. 1.

Referring to FIG. 2, a front view of the barrier alarm 10 of the present illustration is shown. As illustrated, the sensor body 17 substantially encloses the operative components of the alarm. The sensor body 17 may be composed of any of several rigid materials, such as a metal or a plastic. The latter form is preferred because of its ability to withstand impact by other rigid objects (such as crates or boxes) without showing any resulting damage. The body 17 is generally hollow. It is to be understood that while the body 17 is shown as having a round shape in cross section, the body 17 could as easily be formed as having a squared, a rectangular, or a triangular shape.

The several operative components of the various embodiments of the barrier alarm illustrated herein may be located on the inside or on the outside of the body 17. For example, in lieu of or in addition to the light 18 mounted on the wall adjacent the opening 12 as shown in FIG. 1, one or more end lights 26 may be attached to the opposing ends of the body 17. These will be described more fully with respect to FIGS. 3 and 4. The lights 26 may be encased in a protective shell or wire cage 27.

A vibration-sensing relay 28 may be externally or internally mounted with respect to the sensor body 17. If externally provided, the relay 28 may be encased in a protective shell or wire cage 19 like the lights 26. The relay 28 may be a mercury switch or similar switching apparatus such as a movable magnet supported within a coil. Regardless of construction, the relay 28 must be capable of differentiating between a smooth, continuous movement such as associated with the swinging arc motion effected by a breeze and the instantaneous vibration effected by being impacted by a rigid object. The relay 28 must be able to differentiate between the two such that it does not respond to the former while it does respond to the latter. The response is in the form of the closing of a circuit between the light 26 (or the light 18 or siren 20) and either a 120-volt AC power supply or a storage battery 30 which may be integrally mated with the body 17 either by external attachment or by internal positioning such as is illustrated in FIG. 2. The relay 28 may also be fitted with a sensitivity adjuster 31 which allows for adjustment of the responsiveness of the relay 28. For example, by moving the adjuster 31, the relay 28 may be altered from being responsive at a 60 degree arc of motion to being responsive at a 30 degree arc of motion.

The arrangement of FIG. 2 wherein the alarm, the power source, and the sensor are all attached to the body 17 may be preferred over other forms in that the barrier alarm 10 could be provided to the consumer in an easily mountable, one-pieced unit. Alternatively, the alarm 10 could be provided in a form that may be integrated with the adjacent door structure as illustrated in FIG. 1.

Figure 3:
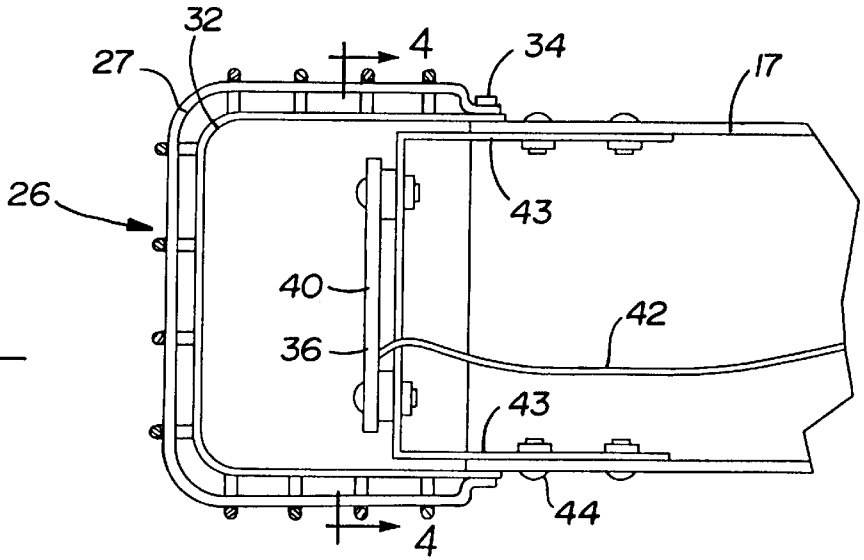
FIG. 3 is a detailed sectional view of a light alarm fitted to the end of the barrier alarm according to the present invention.
Figure 4:
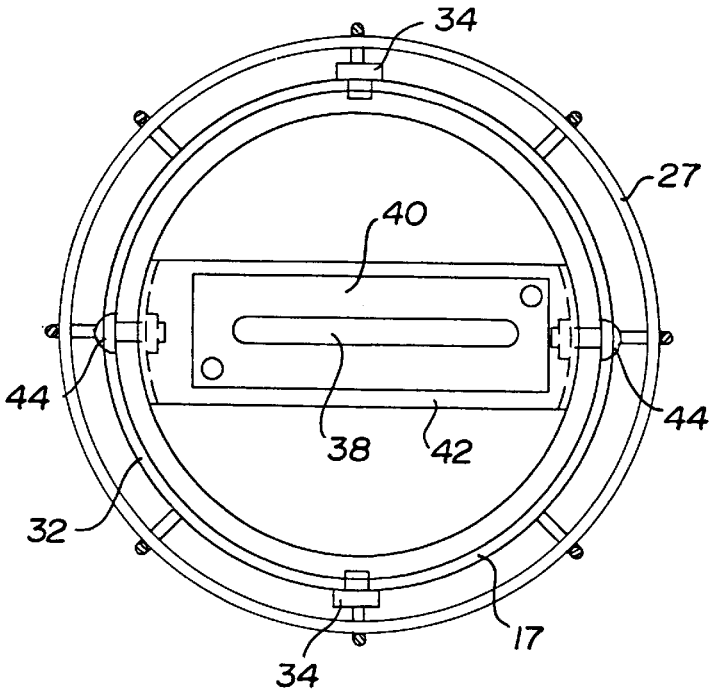
FIG. 4 is an end view of the light taken along line 4—4 of FIG. 3.

FIG. 3 illustrates a detailed sectional view of one of the lights 26. FIG. 4 illustrates an end view of the light 26 of FIG. 3 taken along line 4—4 of FIG. 4. The light 26 includes a semi-transparent, preferably colored cover 32 mounted by fasteners 34 to the body 17. While the color of the cover 32 may be one of many possible colors, a bright color such as yellow, orange, or red are preferred. (The color red may be inappropriate in certain environments such as in an auto plant, where red lights are generally restricted to use as emergency alarms.)

Within the cover 32 is fitted a light-emitting element such as element 36. The element 36 may be a conventional incandescent light or may be a strobe lamp 38. In the event of the latter construction and as illustrated, the strobe lamp 38 is attached to a strobe light circuit 40 which is itself wired by a conduit 42 to the power source 30 and the relay 28. The lamp 38 and its associated circuit 40 are mounted on a bracket 43 which is mounted to the body 17 by fasteners 44.

Figure 5:
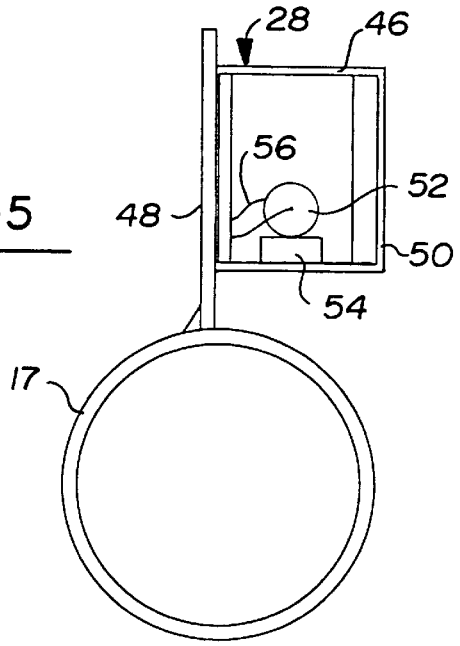
FIG. 5 is a sectional view of the alarm relay of the present invention in its association with the body of the alarm taken along line 5—5 of FIG. 2.
Figure 6:
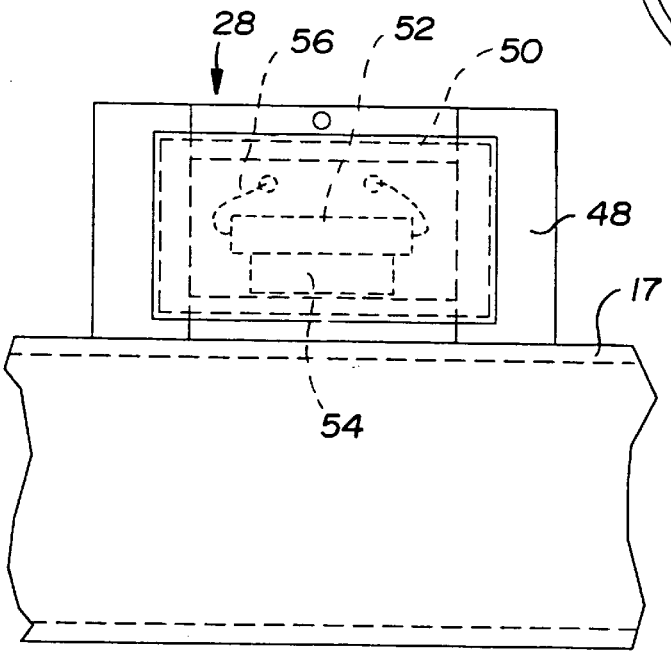
FIG. 6 is a frontal, partially sectioned view of the alarm relay of FIG. 5 and its association with the body of the alarm.

FIG. 5 illustrates a side view of the relay 28 and a portion of the body 17 taken along line 5—5 of FIG. 2. FIG. 6 illustrates a partially sectioned view of the relay 28 and the body 17. The relay 28 includes a sensor box unit 46 that is mounted to the body 17 by a support bracket 48. The sensor box unit 46 comprises a guard unit defined by a protective box 50 and a relay switch 52 (shown in broken lines). The switch 52 is supported within the box 50 by a base 54 (shown in broken lines) and is wired to the power source 30 and the lights 26 (or remote alarm) by the appropriate wiring 56 (shown in broken lines). The relay switch 52 may be of the mercury switch type. However, it is to be understood that other forms of the switch may well be suited for use in the present invention. The only limitation of the switch design is that it be selectively responsive to movement of the body 17 such that it only be sensitive to instantaneous vibration and not to the steady swaying movement generated by wind.

FIG. 1 illustrates the barrier alarm 10 in one of its conventional applications in position above the opening 12. However, the alarm 10 may be positioned in other areas around the opening 12. Some of these variations are shown in FIGS. 7 and 8.

Figure 7:
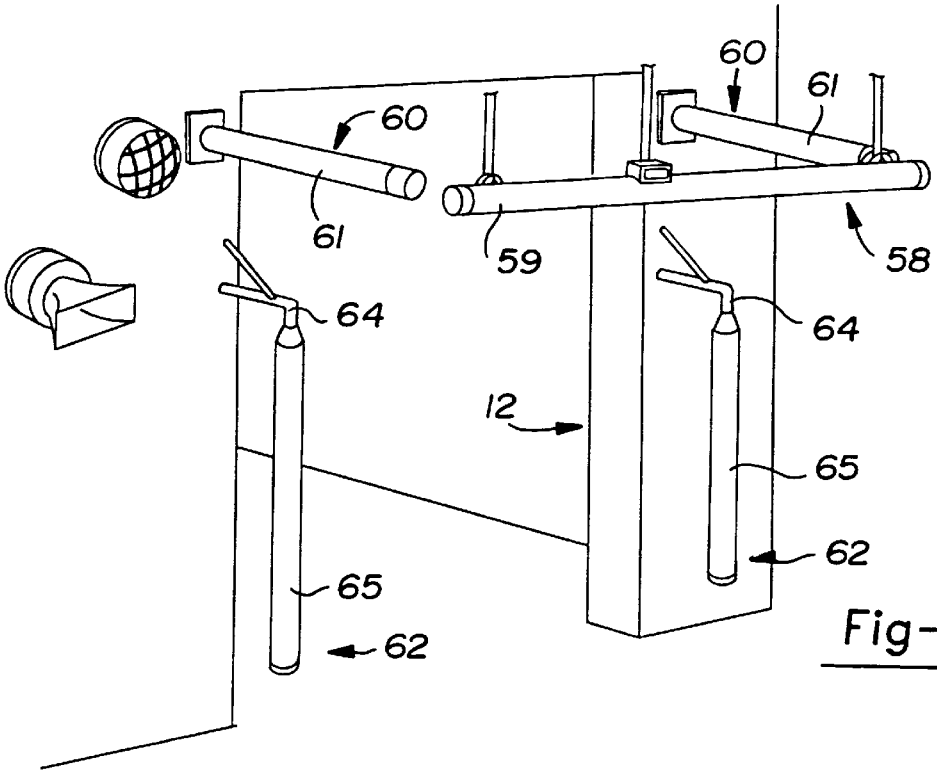
FIG. 7 is a perspective view of an array of horizontal barrier alarms and a pair of suspended vertical arms of the present invention positioned about a door opening.

With reference to FIG. 7, a barrier alarm 58 is horizontally situated in a position spaced-apart from the door opening 12. The barrier alarm 58 includes a sensor body 59. Additional barrier alarms 60 may be attached to the walls adjacent to the opening positioned in a manner that extends away from the supporting wall adjacent the opening. Each of the barrier alarms 60 includes a sensor body 61. The arrangement of the barrier alarm 58 and the alarms 60 defines a "U" shape in which the opening of the "U" is directed to the door opening. The purpose of this arrangement is to alert high-low operators, for example, to the risk of trying to move an overly-tall article through the opening 12 as they approach the opening 12 laterally as opposed to directly as shown in FIG. 1. In this situation, the top of the opening 12 is fully protected regardless of the approach taken by the operator.

FIG. 1 illustrates a pair of alarms 21 that are vertically positioned with respect to the floor and are fitted to the walls adjacent the door opening 12. It may be desirable, however, to suspend the alarms from the wall itself. Accordingly, as illustrated in FIG. 7, a pair of spaced apart vertical barriers 62 are suspended from hangers 64 which are themselves mounted to the walls adjacent the door opening 12. The barriers 62 each includes a sensor body 65. This free-swinging arrangement minimizes damage to the barriers 62 if impacted by a vehicle or by carried goods. This arrangement, accordingly, provides for the relatively free swinging of the barriers 62.

Figure 8:
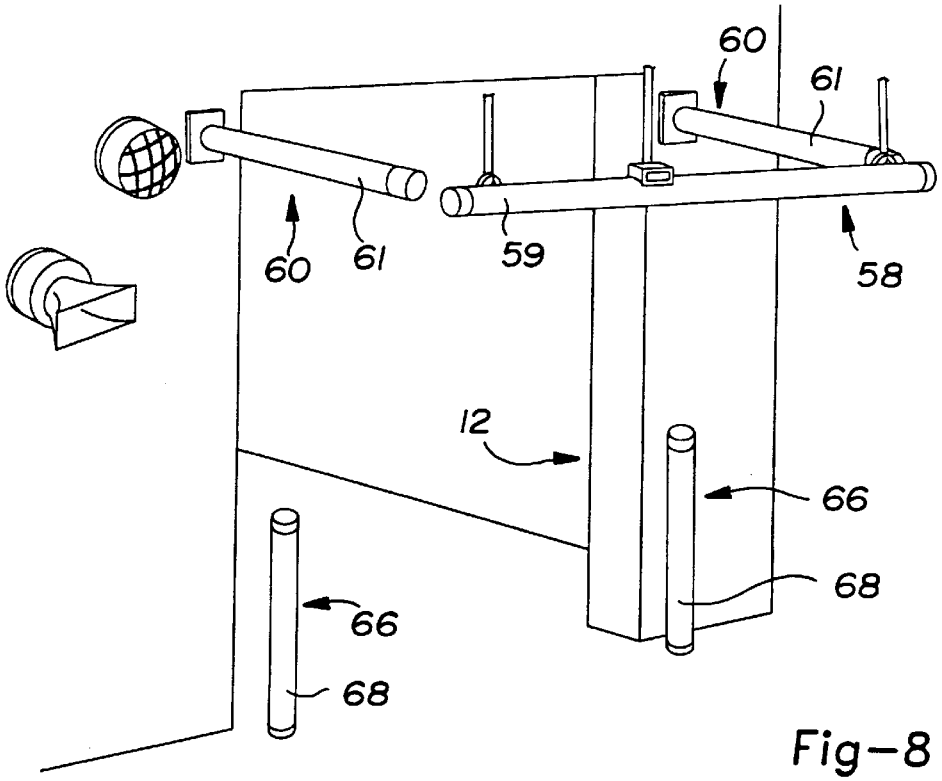
FIG. 8 is a perspective view similar to that of FIG. 7 but illustrating ground-mounted vertical alarms in addition to the horizontal alarms of FIGS. 1 and 7.

An additional arrangement of vertically-positioned barrier alarms according to the present invention is illustrated in FIG. 8 in which a pair of barriers 66 are mounted directly to the floor. The barriers 66 each include a sensor body 68. According to this construction and as with the arrangement of the barrier alarms 21 of FIG. 1, the barrier alarms 66 may be mounted to the floor by a semi-flexible member such as a spring (not shown). Alternatively, the alarms may be mounted such that they may be broken away from the floor if struck by a moving object. While this would lead to damage to the alarm 66, the door opening 12 would be saved from injury. This is a far less costly outcome than the opening 12 suffering injury.

Having described my invention, many modifications thereto will become apparent to those skilled in the art to which it pertains without deviating from the spirit of the invention as defined by the scope of the appended claims. For example, while the various figures have shown that the barrier alarm of the present invention may be positioned on one side of a door opening, it is to be understood that the alarms may as easily be positioned as well on both sides of the opening.

I claim:

1. A barrier alarm positionable on a surface by a door opening, the barrier alarm comprising:

an elongated body attached to the surface by the door opening, said body having a first end and a second end;

a first arm connecting said first end of said body to the surface by the door opening, said first arm maintaining said first end of said body in a spaced apart relation with respect to the surface by the door opening;

a second arm connecting said second end of said body to the surface by the door opening, said second arm maintaining said second end of said body in a spaced apart relation with respect to the surface by the door opening;

a movement-responsive alarm relay operatively associated with said body;

an alarm;

a power source; and circuitry for connecting said relay, said alarm, and said power source, whereby substantially sudden impact of a moving article against said body effects an alarm response through the connection of said circuitry.

2. The barrier alarm of claim 1, wherein said body comprises an elongated member.

3. The barrier alarm of claim 2, wherein said elongated member is substantially hollow.

4. The barrier alarm of claim 1, wherein said movement-responsive alarm relay is a mercury switch.

5. The barrier alarm of claim 1, wherein said alarm is an audible alarm.

6. The barrier alarm of claim 1, wherein said alarm is a visible alarm.

7. The barrier alarm of claim 6, wherein said visible alarm comprises a light integrally mounted on said body.

8. The barrier alarm of claim 7, wherein said light is a strobe light.

9. The barrier alarm of claim 1, further including a semiflexible member for attaching said body to a surface in proximity to the door opening.

10. The barrier alarm of claim 1, wherein the sensitivity of said alarm to said movement may be adjusted, the alarm further including means for adjusting said sensitivity.

11. An alarm system for announcing when an article is too large to be passed through an opening, the opening having adjacent surfaces, the system comprising:

means for sensing and responding to the approach of the article to the opening, said means for sensing and responding including a first end and a second end;

means for announcing the approach of the article associated with the means for sensing and responding;

a first support for attaching said first end of said means for sensing and responding to one of the adjacent surfaces by the opening such that said first end is maintained in a spaced apart relation with respect to the adjacent surfaces;

a second support for attaching said second end of said means for sensing and responding to one of the adjacent surfaces by the opening such that said second end is maintained in a spaced apart relation with respect to the adjacent surfaces; and a power supply for powering said means for sensing and responding.

12. The alarm system of claim 11, wherein said means for sensing and responding comprises an elongated body.

13. The alarm system of claim 12, wherein said means for sensing and responding includes a movement-sensitive relay.

14. The alarm system of claim 13, wherein said movement-sensitive relay includes a mercury switch.

15. The alarm system of claim 13 wherein said power source is a battery integrated with said elongated body.

16. The alarm system of claim 13, wherein said means for sensing and responding includes an alarm light integrally mated with said elongated body.

17. The alarm system of claim 13, wherein said means for announcing includes an audio alarm.

18. A barrier alarm for attachment adjacent the door jamb of a door, the alarm comprising:

an elongated, tubular body, said body having a first end and a second end;

a first visual alarm attached to said first end;

a second visual alarm attached to said second end;

a first arm fitted adjacent said first visual alarm for attaching said body to the door jamb;

a second arm fitted adjacent said second visual alarm for attaching said body to the door jamb;

a movement sensitive relay integrally mated with said body;

means for announcing movement of said body integrally associated with said body;

a power source; and circuitry connecting said relay, said means for announcing, and said power source.

* * * * *